United States Patent [19]

Kozuka et al.

[11] 4,096,543

[45] Jun. 20, 1978

[54] CORONA DISCHARGE DEVICE WITH GRID GROUNDED VIA NON-LINEAR BIAS ELEMENT

[75] Inventors: Nobuhiko Kozuka, Suita; Shoji Matsumoto, Neyagawa; Tetsuya Okada, Takatsuki; Katsuhiko Gotoda; Tatsuo Aizawa, both of Osaka, all of Japan

[73] Assignee: Mita Industrial Company, Ltd., Osaka, Japan

[21] Appl. No.: 735,505

[22] Filed: Oct. 26, 1976

[30] Foreign Application Priority Data

Oct. 25, 1975 Japan ..... 50-127886

[51] Int. Cl.[2] ..... H01T 19/00

[52] U.S. Cl. ..... 361/230; 361/235

[58] Field of Search ..... 361/212, 213, 229, 230, 361/235

[56] References Cited

U.S. PATENT DOCUMENTS

| | | | |
|---|---|---|---|
| 3,370,212 | 2/1968 | Frank | 361/229 |
| 3,714,531 | 1/1973 | Takahashi | 361/235 |
| 3,764,866 | 10/1973 | Bonaventura et al. | 361/230 |
| 3,775,104 | 11/1973 | Matsumoto et al. | 361/229 |
| 3,789,278 | 1/1974 | Bingham et al. | 361/230 |

*Primary Examiner*—Gerald Goldberg

*Attorney, Agent, or Firm*—Sherman & Shalloway

[57] ABSTRACT

A corona discharge device including a corona discharge electrode, an opposing electrode disposed opposite to the corona discharge electrode, a high voltage alternate current source electrically connected between the two electrodes, and a grid provided in a corona discharge current flow path between the two electrodes. The grid is grounded through a nonlinear bias element.

9 Claims, 25 Drawing Figures

Fig. 11
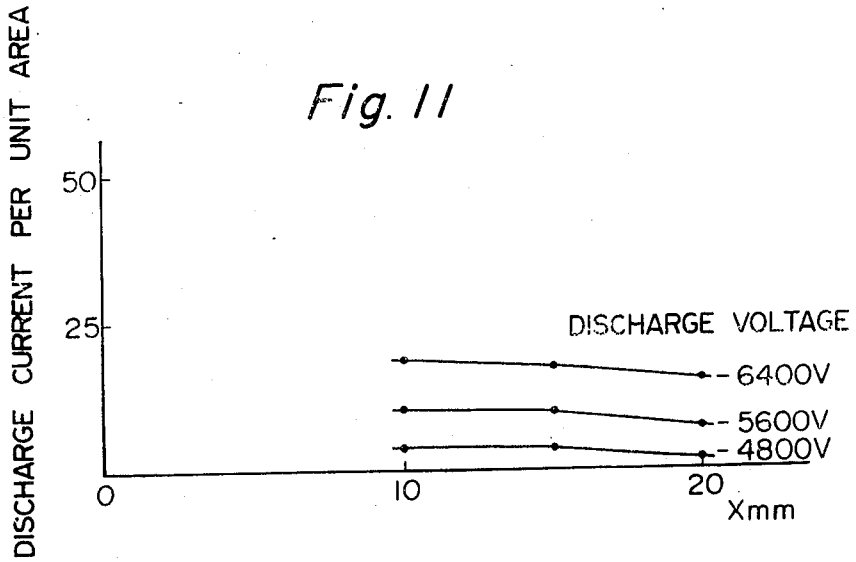
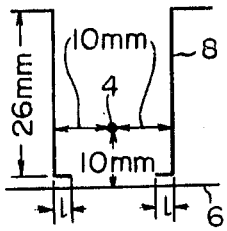
Fig. 12a
Fig. 12b
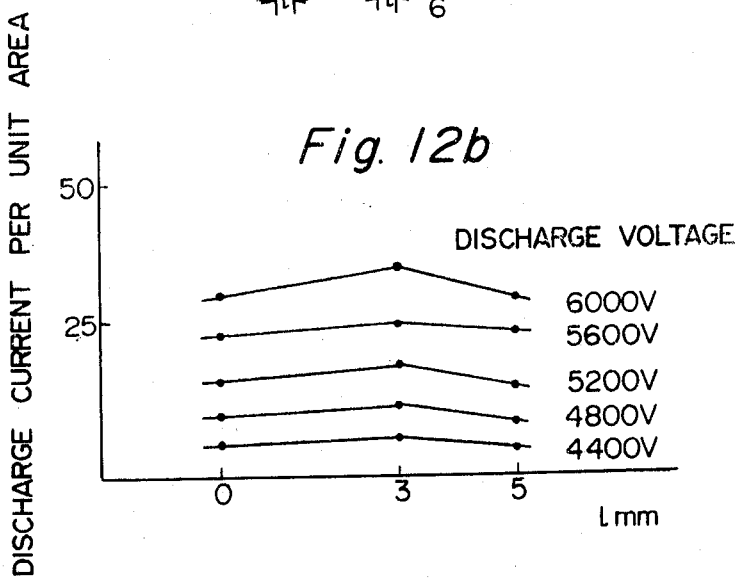

CORONA DISCHARGE DEVICE WITH GRID GROUNDED VIA NON-LINEAR BIAS ELEMENT

FIELD OF THE INVENTION

This invention relates to a corona discharge device, and more specifically to a corona discharge device that can be conveniently used in various types of electrophotographic process.

DESCRIPTION OF THE PRIOR ART

A corona discharge device having a discharge electrode, an opposing electrode, a high voltage alternate current source for applying a high alternate current voltage across the two electrodes is known in the prior art. The prior art also teaches using a grid placed in the corona discharge current flow path between the two electrodes and having applied thereto a fixed bias voltage for use in an electrophotographic process (for example, U.S. Pat. No. 2,777,957).

Japanese Patent Publication No. 5466/74(particularly FIG. 6-*a*), which corresponds to U.S. Pat. No. 3,775,104 discloses a corona discharge device including a discharge electrode, an opposing electrode and a grid disposed between the two electrodes with a fixed DC bias voltage of a predetermined magnitude. This device can be conveniently used for secondary charging in an electrophotographic process which comprises primarily charging the surface of a photosensitive laminate by applying a DC corona discharge thereto, and simultaneously with light and dark imagewise exposure, secondarily charging it by applying an asymmetric AC corona discharge. The ratio of the discharge current, which has the same polarity as the primary charge, to a discharge current having an opposite polarity thereto is within a predetermined range.

Furthermore, Japanese Laid-Open Patent Publication No. 3747/73 discloses a corona discharge device including a discharge electrode, an opposing electrode, and a grid disposed therebetween and directly grounded for use in secondary charging in an electrophotographic process. The process comprises charging the surface of a photo-sensitive laminate to the desired polarity by applying a DC corona discharge thereto, and simultaneously with light and dark imagewise exposure, subjecting it to secondary charging to remove charge from the surface of the photosensitive laminate.

These known corona discharge devices including a discharge electrode, an opposing electrode and a grid disposed in a corona discharge current flow path between the two electrodes and either directly grounded or having applied thereto a fixed bias voltage can be used conveniently in various electrophotographic processes, as disclosed, for example, in Japanese Patent Publication No. 5466/74 and Japanese Laid-Open Patent Publication No. 3747/73. They however, suffer from various defects. For example, they require a fixed bias voltage source for applying a fixed bias voltage to the grid, and therefore, the initial manufacturing and operating costs are relatively high. Since the grid is directly grounded or a fixed bias voltage is applied to the grid, the action of the grid on the corona discharge current and the characteristics of the corona discharge current cannot be freely changed. Moreover, the charging and charge-eliminating steps in various electrophotographic processes must be performed at higher speeds in order to obtain latent images or visible images at higher speeds. The known corona discharge devices described above cannot fully meet this demand.

SUMMARY OF THE INVENTION

It is an object of the disclosed invention to provide a corona discharge device which does not require a special voltage source for applying a bias voltage to control the corona discharge current, and which has low initial manufacturing and operating costs.

Another object of this invention is to provide a corona discharge device in which the speeds of charging and charge-elimination are faster than in conventional corona discharge devices.

Still another object of this invention is to provide a corona discharge device in which the corona discharge current can be freely controlled.

The present invention provides a corona discharge device comprising a corona discharge electrode, an opposing electrode disposed opposite to the corona discharge electrode, a high voltage alternate current source electrically connected between the two electrodes, and a grid disposed in a corona discharge current flow path between the two electrodes and grounded through a nonlinear bias element.

The corona discharge device of the invention does not require a special bias voltage source, but the nonlinear bias element connected to the grid forms a self-bias to cause the grid to act favorably on the corona discharge current. In addition, the action of the grid on the corona discharge current, and therefore the characteristics of the corona discharge current itself, can be very easily controlled. This is accomplished by adjusting the impedance of an AC impedance element, such as by use of a variable resistance which constitutes part of the nonlinear bias element. The corona discharge device of the invention can perform charging and charge-elimination of chargeable surfaces in various electrophotographic processes at higher speeds than the conventional corona discharge devices.

Accordingly, the corona discharge device of the invention can be conveniently used for charging and charge-elimination in various electrophotographic processes. In particular, it can be conveniently used as a corona discharge device for secondary charging in the electrophotographic process disclosed in Japanese Patent Publication No. 5466/74 cited above. Therein charging the surface of a photosensitive laminate by applying a DC corona discharge of a specified polarity thereto, and then with simultaneous light and dark imagewise exposure, performing secondary charging is taught. The secondary charging is accomplished by applying a nonlinear AC corona discharge in which the ratio of a discharge current of the same polarity as the primary charging to a discharge current of the opposite polarity to the primary charging is within a predetermined range. The corona discharge device of the invention can also be used conveniently in a charge-eliminating step of various types of electrophotographic processes which, for facilitating the subsequent formation of a latent image, eliminates the remaining charge which has been applied to the surface of a chargeable material by the previous latent image-forming step. It can also be used conveniently in a charging step of an electrophotographic process of the electrofax type in place of the corona discharge devices disclosed in Japanese Patent Publication No. 9791/65 and Japanese Utility Model Publication No. 20364/65.

The above and other objects of the invention will become apparent from the following description.

BRIEF DESCRIPTION OF THE DRAWINGS

FIGS. 10*a*, 12*a*, 13*a* and 14*a* are simplified views showing various embodiments of a discharge electrode and a shield case;

FIGS. 10*b*, 11, 12*b*, 13*b* and 14*b* are diagrams showing the relation of the distance X of the embodiments of the discharge electrode and shield case to the discharge current;

DETAILED DESCRIPTION OF PREFERRED EMBODIMENTS

Figure 1:
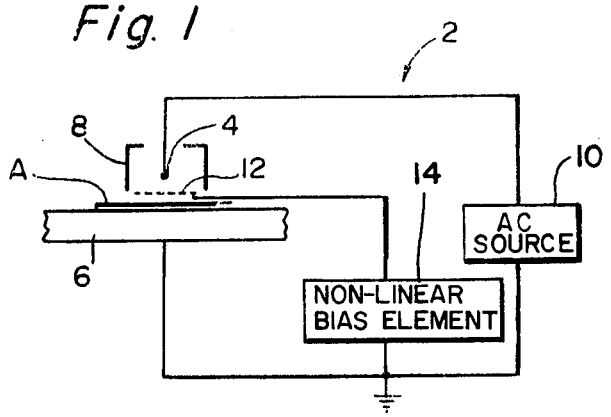
FIG. 1 is a simplified view of the corona discharge device of this invention.

By reference to FIG. 1, a preferred embodiment of the corona discharge device of the invention is shown which is suitable for the charging or charge-elimination of the surface of a chargeable material A. The material A is composed of a single layer or a laminate comprising a conductive layer, a photoconductive layer and an insulator layer.

The corona discharge device 2 comprises a discharge electrode 4 made of, for example, a tungsten filament, a discharge needle, or a metal foil, an opposing electrode 6 disposed opposite to the discharge electrode, and a shield case 8. When the shield case 8 is used in the simultaneous step of secondary charging and exposing, it may be opened at the top. Between the discharge electrode 4 and the opposing electrode 6 is electrically connected a high voltage AC source 10 for applying a high AC discharge voltage across the two electrodes to generate a corona discharge current. A grid 12 of a conventional type is disposed in a discharge current flow path between the electrodes 4 and 6 (between the discharge electrode 4 and the surface of chargeable material A in the drawing). The grid 12 is connected to the opposing electrode 6 or is grounded through a nonlinear bias element 14. In the embodiment illustrated, the grid 12 is connected to a line connecting the opposing electrode 6 to the high voltage AC source 10, and grounded.

The term "nonlinear bias element," as used in the present application, denotes a bias element which gives different impedances according to positive and negative currents, and, for example, can be built by parallel-connecting an AC impedance element and a rectifier, or by parallel-connecting an AC impedance element and a constant-voltage rectifier.

The AC impedance element is an element that can be built of a resistor, a condenser, and a coil, etc. taken alone or in combination, and is preferably a variable AC impedance element.

Figure 2A:
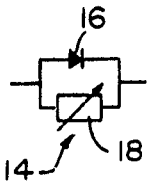
FIGS. 2*a* and 2*b* are simplified views showing preferred forms of the nonlinear bias element used in the corona discharge device of this invention.
Figure 2B:
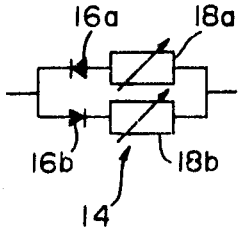
Figure 3:
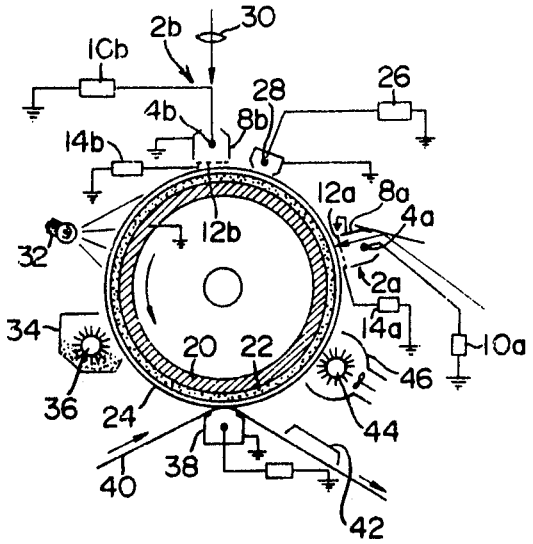
FIG. 3 is a simplified view of an electrophotographic apparatus in which the corona discharge device of the invention is used for secondary charging and charge elimination.

FIGS. 2*a* and 2*b* show preferred form of the nonlinear bias element 14. The nonlinear bias element 14 of FIG. 2*a* is made by connecting a rectifier 16 and a variable AC impedance element 18 in parallel. The nonlinear bias element shown in FIG. 2*b* is constructed by series-connecting a rectifier 16*a* and a variable AC impedance element 18*a*, series-connecting a rectifier 16*b* and a variable AC impedance element 18*b*, and parallel-connecting the two series connections. The rectifiers 16*a* and 16*b* have opposite polarities to each other. In the nonlinear bias element 14 shown in FIG. 2*a*, the variable AC impedance element 18 acts as impedance to either a positive or negative electric current. Accordingly, by adjusting the impedance of the AC impedance element, either one of the positive and negative currents, and therefore the bias voltage, can be selectively adjusted with respect to to the other. In the nonlinear bias element 14 shown in FIG. 2*b*, the AC impedance element 18*a* acts as impedance to either one of the positive and negative currents, and the AC impedance element 18*b* acts as impedance to the other current independant of element 18*a*. Hence, the positive and negative currents passing through the nonlinear bias element 14 and, therefore the bias voltage, can be separately and independently controlled by adjusting the AC impedance elements 18*a* and 18*b*.

The corona discharge device 2 described hereinabove can be used as a corona discharge device for secondary charging in the electrophotographic process disclosed. For example, in Japanese Patent Publication No. 5466/74 which basically comprises primarily charging the surface of a photosensitive laminate by applying a DC corona discharge of a specified polarity thereto, and then simultaneously with light and dark imagewise exposure, secondarily charging it by applying an asymmetric AC corona discharge in which the ratio of a discharge current having the same polarity as the primary charging to a discharge current having an opposite polarity to the primary charging is within a specified range. The device 2 can also be conveniently used for eliminating charge on the surface of the photosensitive laminate prior to the primary charging.

An electrophotographic apparatus for carrying out the aforementioned electrophotographic process in which corona discharge devices in accordance with this invention are used for secondary charging and charge elimination is described briefly hereinbelow.

A photoconductive layer 22 and a light-transmitting surface insulator layer 24 are provided on a crylindrical electroconductive base plate 20 which is grounded and acts as an opposing electrode for various corona discharge devices to form a photosensitive drum. The photosensitive drum is rotated in the direction of the arrow, and successively arrives at various treating zones disposed on the periphery of the drum. First, a charge eliminator 2a composed of the corona discharge device in accordance with this invention reduces the surface potential of the surface 24 of the drum to substantially a zero potential. The charge-eliminator 2a will be described in detail later on. Then, a DC corona discharge device of a conventional type having a discharge electrode 28 connected to a DC source 26 imparts a positive or negative DC corona discharge to the drum surface. The drum surface is exposed imagewise by an exposing device 30 disposed adjacent to the corona discharge device, and simulataneously charged by an asymmetric AC corona discharge from a secondary charging device 2b composed of the corona discharge device of this invention. The secondary charging device 2b will be described in detail later on. Then, the drum surface is uniformly exposed over the entire surface by a light source 32 whereby a light and dark electrostatic latent image having opposite charge polarities and opposite potential polarities is formed on the drum surface. The electrostatic latent image is developed with a toner charged to the opposite polarity to the electrostatic latent image by means of a magnetic brush 36 within a developing mechanism 34. The image developed in this manner is transferred to a transfer sheet 40 in a transfer zone equipped with a corona discharge device 38 of a known type. The transfer sheet 40 having a toner image transferred thereto is conducted to a fixation mechanism 42 where the toner image is fixed. In the meanwhile, the photosensitive drum is cleaned by a cleaning device 46 equipped with a toner-removing brush 44, and the next cycle of copying is performed.

The charge-eliminator 2a composed of the corona discharge device in accordance with the present invention includes a discharge electrode 4a, a shield case 8a which is grounded, a high voltage AC source 10a connected to the discharge electrode 4a, and a grid 12a disposed between the discharge electrode 4a and the surface 24 of the photosensitive drum and grounded via a nonlinear bias element 14a. Since the charge on the border between the photosensitive layer 22 and the surface insulator layer 24 is generally difficult to remove by discharge current alone, it is preferred that the top of the shield case of the eliminator 2a be opened so that light from a suitable light source (not shown) may be irradiated onto the surface of the photosensitive drum, preferably at the central portion of the charge-eliminator.

Heretofore, an ordinary AC corona discharge device has been used as an eliminator for eliminating charges on the surface of a photosensitive drum. But as is well known to those skilled in the art, an AC corona discharge current generated by an ordinary AC corona discharge device has a somewhat greater negative current component than its positive current component, and this accordingly tends to render the surface of the photosensitive drum somewhat negative after elimination of the charge thereon by the AC corona discharge. According to the corona discharge device of this invention, however, the ratio of positive component to negative component of the discharge current can be controlled as required by prescribing the impedance of an AC impedance element of the nonlinear bias element 14a connected to the grid 12a at a suitable value. For example, the ratio can be adjusted exactly to 1:1, or the positive component can be made larger than the negative component. The eliminator 2a composed of the corona discharge device of this invention can adjust the surface potential of the photosensitive drum stably to substantially a zero potential, or to any other desired value as a result of charge elimination by the discharge current and the light irradiated onto the surface of the drum through the top opening of the shield case.

The secondary charging device 2b composed of the corona discharge device of this invention includes a discharge electrode 4b, a grounded shield case 8b having a top opening for simultaneous imagewise exposure by an exposing mechanism 30, a high voltage AC source 10b connected to the discharge electrode 4b, and a grid 12b disposed between the discharge electrode 4b and the surface of the photosensitive drum and grounded through a nonlinear bias element 14b.

In the secondary charging device 2b, the actions of the nonlinear bias element 14b and the grid 12b, without requiring any bias voltage source, convert the discharge current applied to the drum surface to an asymmetric AC corona discharge current in which the ratio of a current component having the same polarity as the primary charging to a current component having an opposite polarity to the primary charging is within a specified range. The asymmetry of the asymmetric AC corona discharge current can be easily adjusted as desired by adjusting the impedance value of an AC impedance element of the nonlinear bias element 14b.

As another important feature, it has been found that the secondary charging device 2b can perform uniform charging at a faster charging speed than a secondary charging device composed of a known corona discharge device having a grid directly grounded or a grid having a fixed bias voltage applied thereto by a bias voltage source.

Generally, in an electrostatic photographic process, higher secondary charging speeds and shorter secondary charging periods result in a higher contrast potential between the light areas and the dark areas of the resulting electrostatic latent image, and clear copied images having superior reproducibility of halftones and fine lines can be obtained. This is probably because the charge induced by the primary charging in a boundary layer between the surface insulator layer and the photoconductive sensitive layer tends to disappear at the time of secondary charging. The more induced charge which disappears results in the secondary charging speed being lower and the secondary charging time being longer, which in turn reduces the contrast potential between the light areas and the dark areas.

This will be readily apparent from FIGS. 4a, 4b and 4c and FIGS. 5a and 5b.

Figure 4A:
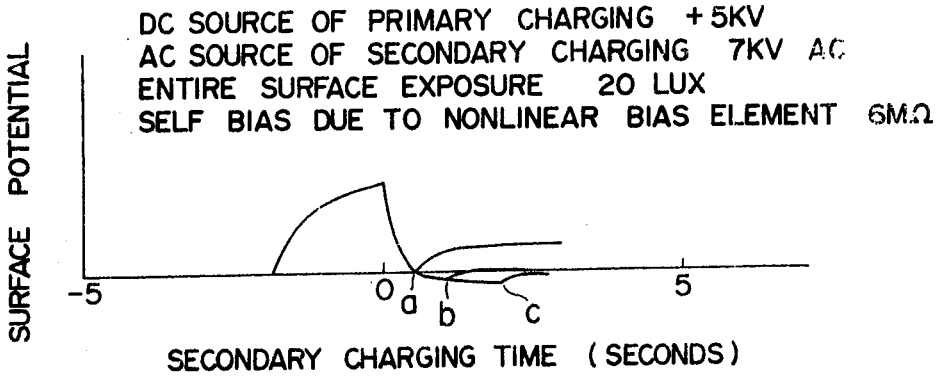
FIGS. 4*a*, 4*b* and 4*c* and FIGS. 5*a* and 5*b* are graphs showing changes in the surface potential of a chargeable material which are caused by secondary charging as compared with the position of the discharge electrode.
Figure 4B:
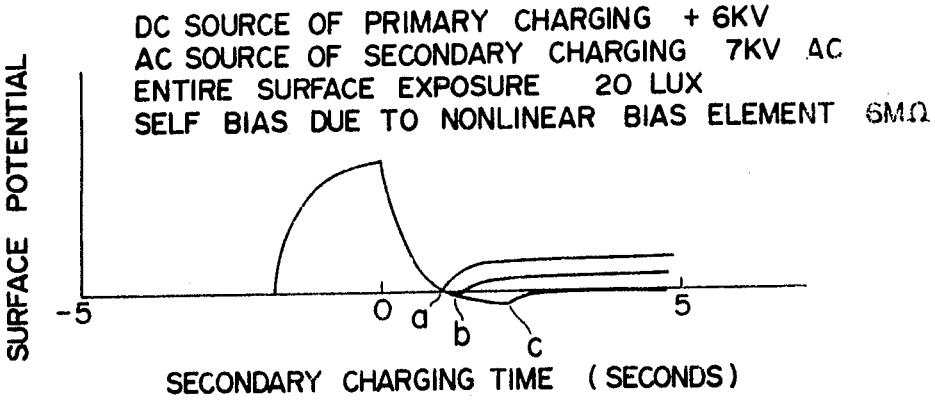
Figure 4C:
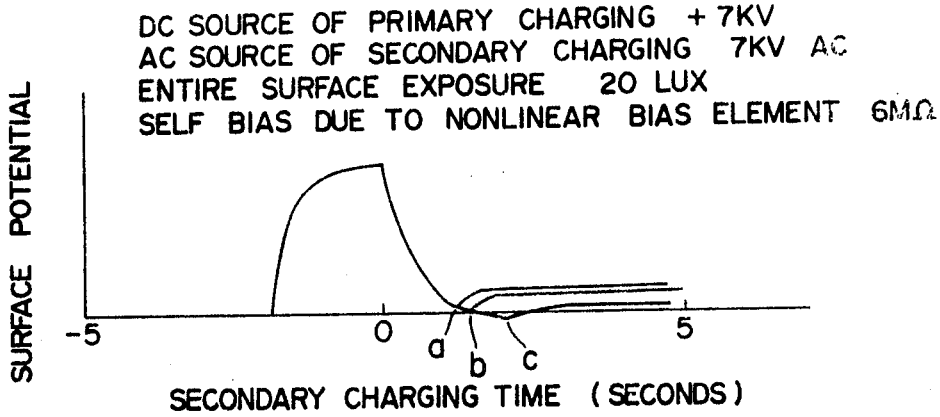
Figure 5A:
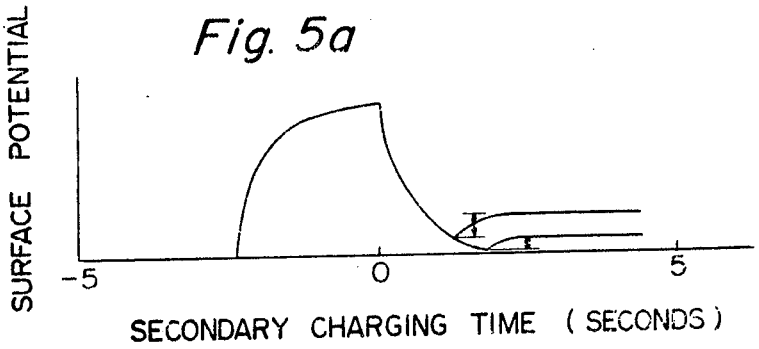
Figure 5B:
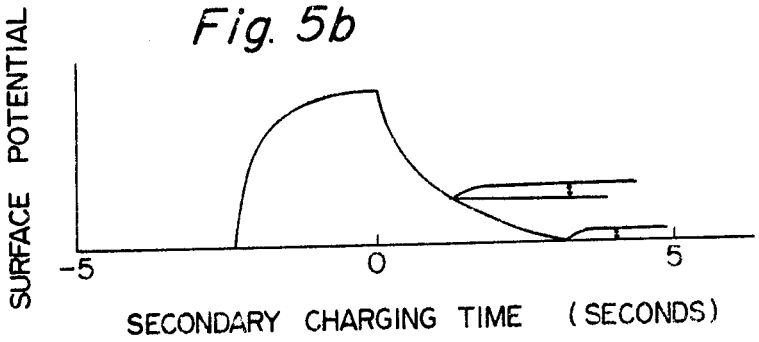

FIG. 4a shows changes in surface potential versus secondary charging time in a process which comprises charging the surface of a photosensitive plate by an ordinary DC corona discharge device (primary charging; DC source +5KV), then secondarily charging it by the corona discharge device of this invention, and exposing it entirely at the times indicated by *a*, *b* and *c* in FIG. 4a. FIG. 4b is a diagram similar to FIG. 4a which shows the results obtained when the surface of the photosensitive plate is charged primarily by a DC source of +6 KV; and FIG. 4c is a diagram similar to FIG. 4a which shows the results obtained when the surface of the photosensitive plate is charged primarily by a DC source of +7 KV. FIGS. 5a and 5b are similar diagrams obtained by using a DC source of +7 KV for primary charging and an AC source of voltages, which differ between FIGS. 5a and FIG. 5b, for secondary charging.

It will be understood from FIGS. 4*a* to 4*c* that the contrast potential is the greatest when the primary charging is about 6 KV (the contrast potential can be considered to correspond to changes in potential after exposure of the entire surface). If the primary charge is low, the amount of the charge induced in a boundary between the photosensitive layer and the surface insulator layer decreases, and therefore, the contrast potential decreases. On the other hand, the contrast potential decreases when the primary charge becomes higher. This is probably because the charge induced at the boundary by the primary charging reaches saturation when the primary charging voltage is about 7 KV. When the primary charge becomes high, the rate of charge elimination by apparent secondary charging decreases, and unless the charge-eliminating time is prolonged, the surface potential cannot be sufficiently reduced. Furthermore, it will be readily understood from FIGS. 4*a* to 4*c* and FIGS. 5*a* and 5*b* that the contrast potential decreases when the secondary charging (charge-eliminating) time increases.

Evidently, therefore, the use of the corona discharge device of this invention having a higher charging (charge-eliminating) speed than the known corona discharge devices can afford clear copied images having superior reproducibility of halftones and fine lines.

Figure 6:
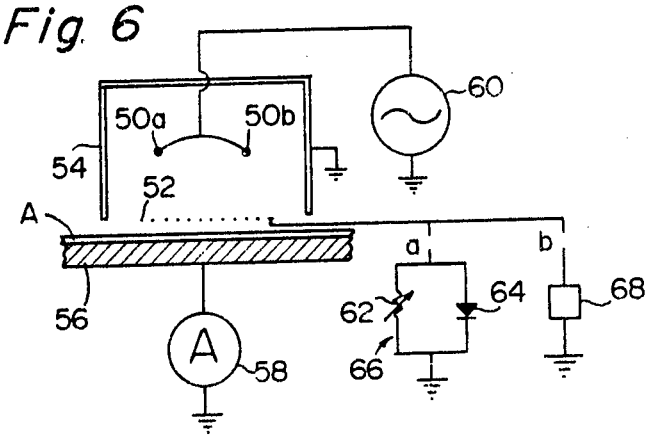
FIG. 6 is a simplified view of apparatus used in various experiments.

The corona discharge device of this invention having a grid grounded via a nonlinear bias element advantageously has a higher charging or charge-eliminating speed than known corona discharge devices equipped with a directly grounded grid, or a grid having a fixed bias voltage applied thereto by a specified bias voltage source. Various experiments were conducted using a corona discharge device illustrated in FIG. 6 in order to compare the charging or charge-eliminating speeds of a known corona discharge device having a directly grounded grid, a known corona discharge device having a grid with a fixed bias voltage applied thereto by a bias voltage source, and a corona discharge device in accordance with the present invention having a grid grounded through a nonlinear bias element or connected electrically to an opposing electrode. In the corona discharge device shown in FIG. 6, 50*a* and 50*b* represent discharge electrodes with a diameter of about 0.06 mm, and 52, a grid having a diameter of about 0.1 mm. The discharge electrodes 50*a* and 50*b* and the grid 52 are fixed to a shield case 54 through an insulator. A represents a chargeable material, and 56, an opposing electrode. The opposing electrode 56 is grounded through an ammeter for measuring a corona discharge current. On the other hand, the discharge electrodes 50*a* and 50*b* are connected to a grounded high voltage source 60. The input voltage of the electric source 60 is adapted to be changed by a slide regulator (not shown). The grid 52 can be grounded through a nonlinear bias element 66 formed by parallel-connecting a variable resistance 62 having a maximum value of 6 megohms and a high voltage rectifier 64 by a connection *a*, or through a high voltage DC source by a connection *b*. By connecting the grid 52 to the nonlinear bias element 66 by the connection *a*, the corona discharge device of FIG. 6 becomes a corona discharge device in accordance with the present invention. When the grid 52 is grounded through the electric source 68 by the connection *b*, the corona discharge device of FIG. 6 becomes a conventional corona discharge device having a grid with a fixed bias voltage applied thereto. When the voltage of the electric source 68 is reduced to zero, the device becomes a known corona discharge device having a directly grounded grid.

Figure 7A:
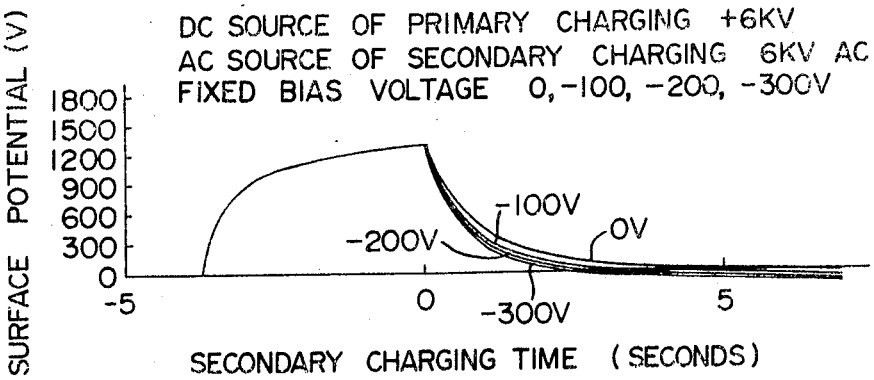
FIGS. 7*a*, 7*b* and 8 are diagrams showing changes in the surface potential of a chargeable material which are caused by secondary charging various corona discharge devices.
Figure 7B:
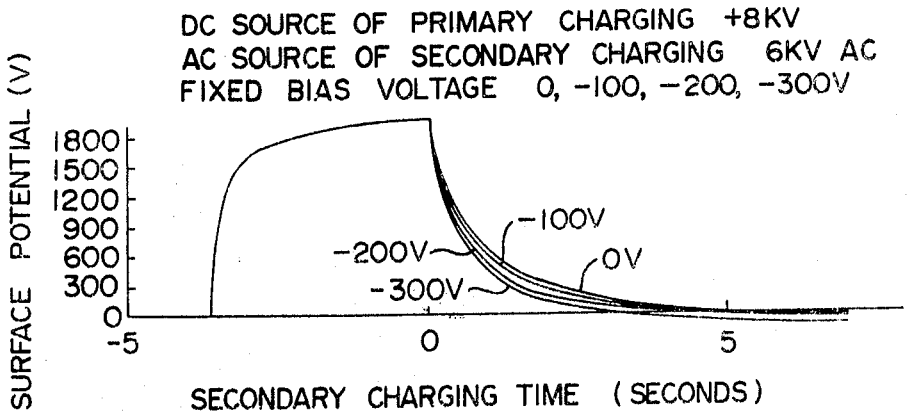

FIGS. 7*a* and 7*b* show changes in the surface potential of a chargeable material which occurred when charging the material by a secondary charging corona discharge device of FIG. 6. Grid 52 was grounded through DC bias source 68 by connection *b* while maintaining constant the DC source voltage of primary charging and the AC source voltage of secondary charging and varying the voltage of the electric source 68 to 0 V (therefore, the grid was directly grounded), −100V, −200 V, and −300 V, respectively. It will be appreciated from FIGS. 7*a* and 7*b* that the charge-eliminating speed increases as the fixed bias voltage becomes greater. For example, in FIG. 7*a*, when the fixed bias voltage is zero, a period of about 5 seconds is required until the surface potential becomes 0 V. But when a fixed bias voltage of −300 V is applied, this period becomes about 2.5 seconds, and the charge-eliminating speed becomes approximately twofold.

Figure 8:
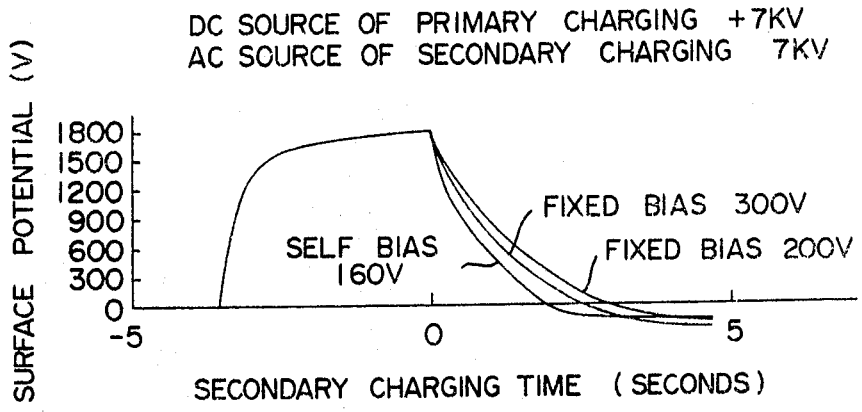

FIG. 8 shows changes in surface potential which occurred when performing primary charging by an ordirary DC corona discharge device having a DC source of +7 KV. The secondary charging was subsequently performed (charge-eleimination) by a corona discharge device shown in FIG. 6 in which a self-bias by a nonlinear bias element 66 is connected to the grid 52 by connection *a*, and a device shown in FIG. 6 in which a fixed bias by DC source 68 is connected to the grid 52 by connection *b*. The resistance value of the nonlinear bias element was about 6 megohms. The self-bias voltage has a much higher pulsation factor (50 or 60 Hz) than the fixed bias, and exhibits a peak voltage of about 225 V when the effective voltage is 160 V. From FIG. 8, it will be readily understood that the self-bias gives a higher charge-eliminating speed than the fixed bias. It will also be appreciated that even when the voltage of the self-bias is pulse-like, the saturated value of the potential of the surface of the chargeable material becomes equal to the peak value of that voltage.

Figure 9:
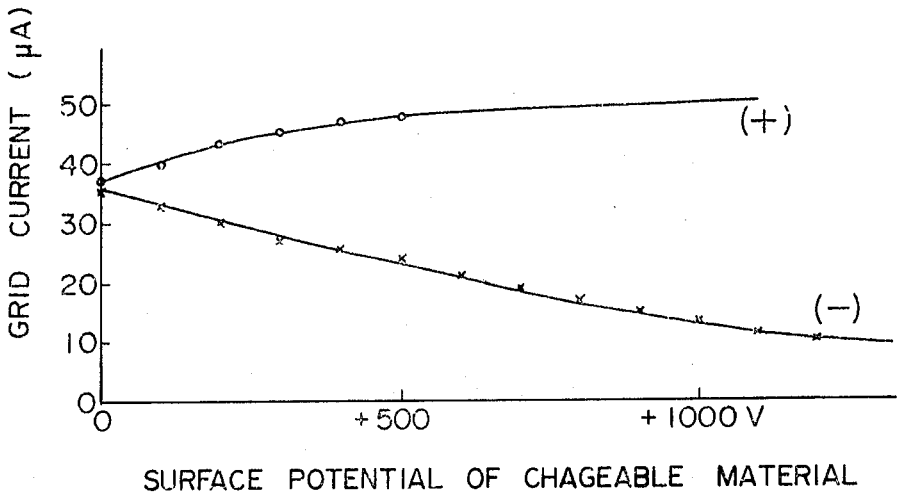
FIG. 9 is a diagram which shows the relation between the current flowing through the grid of the corona discharge device of the invention and the surface potential of a chargeable material.

As mentioned above, the use of the corona discharge device of this invention in which the grid is grounded through the nonlinear bias element gives a higher charging (charge-eliminating) speed than the known corona discharge devices with the grid directly grounded, or grounded through a fixed bias source. The reason for this can be ascribed to the following FIG. 9 shows changes in the current flowing through the grid grounded via the nonlinear bias element versus the surface potential of the chargeable material. For example, when the surface potential of the chargeable material is +1000 V, the positive component of the grid current is about 50 μA and its negative component is about 14 μA at an AC corona source voltage of 5.6 KV and a self-bias resistance of $3 \times 10^6$ ohms (3 megohms). When the corona discharge is continued, the charge on the surface of the chargeable material is gradually eliminated, and its potential is reduced. For example, when the surface potential of the chargeable material is reduced to +200 V, the positive component of the grid current becomes about 44 μA, and its negative component increases to about 30 μA. This increase in the negative component and the decrease in the positive component naturally mean an increase in the negative component of the self-bias voltage and a decrease in its positive component. Consequently, the self-bias voltage by the nonlinear bias element becomes higher in the direction in which charging (charge-elimination) proceeds with the advance of charging (charge-elimination). This is considered to contribute to the increase of the charging (charge-eliminating) speed.

Generally, the charging of the surface of a chargeable material is determined by an arithmetic sum of the amount of charge from the discharge electrode and the amount of charge leaked through the chargeable material. In other words, the arithmetic sum of the amount of the charge which flies to the surface of the chargeable material and the amount of the charge that leaks through the bulk of the chargeable material is the amount of the charge accumulated on the surface of the chargeable material per unit time. The potential of the surface of the chargeable material is determined by the amount of the charge accumulated. Accordingly, in order to increase the speed of charging or charge-elimination of the surface of a chargeable material, it is necessary to increase the amount of the charge which flies to the surface of the chargeable material from the discharge electrode per unit time. Generally, the current I is expressed by the equation $$I = dQ/dt$$

wherein $Q$ is the charge, and $t$ is the time. In order, therefore, to increase the charging or charge-eliminating speed, the corona discharge current must be increased.

The present inventors have experimentally ascertained that the discharge current from the discharge electrode is considerably affected by the relative positions of the discharge electrode and the shield case, the shape and properties of the shield case, and the diameter of the discharge electrode, etc. This experiment will be described below.

Figure 10A:
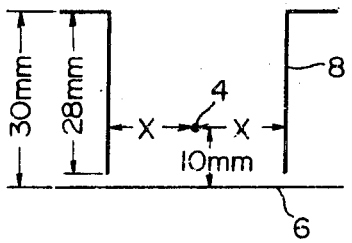
Figure 10B:
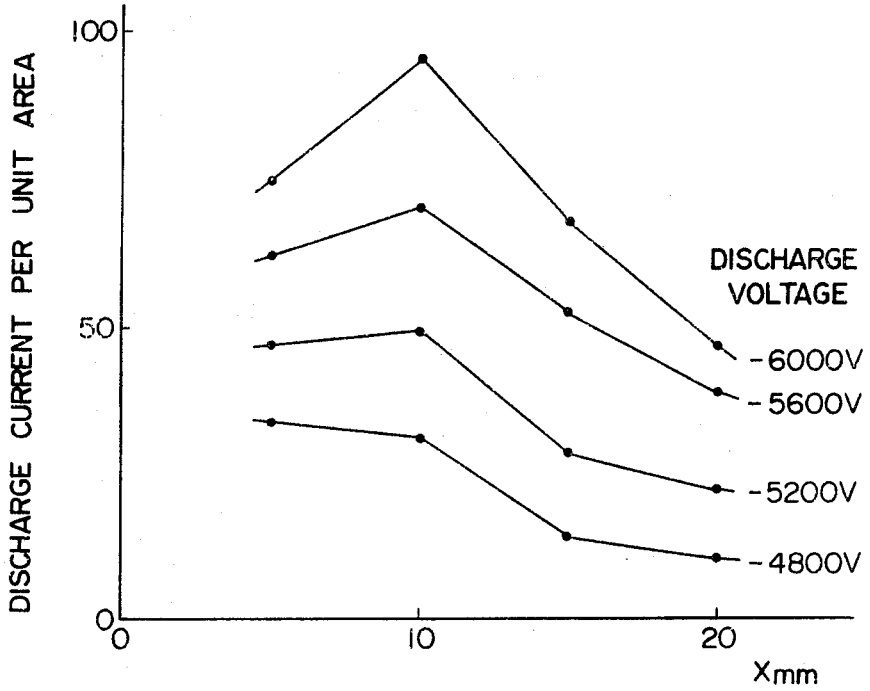

In Embodiment 10*a*, a device comprising a discharge electrode 4, a shield case 8 and an opposing electrode 6 shown in FIG. 10*a*, changes in discharge current according to changes in the distance $x$ between the discharge electrode and the side plate of the shield case 8 were examined. In FIG. 10*a*, the discharge electrode used was a tungsten filament having a diameter of about 0.08 mm. The changes in discharge current versus the changes in distance $x$ are shown in FIG. 10*b*. In calculating the discharge current per unit area, $2x$ multiplied by $l$($l$ being the length of the discharge electrode) was considered as a discharge area.

It will be understood from FIG. 10*b* that the maximum discharge current can be obtained when the distance $x$ is about 10 mm. If the distance $x$ is less than 10 mm, spark discharge is liable to occur between the discharge electrode and the shield case. Hence, the distance $x$ is preferably adjusted to 10 to 15 mm. FIG. 10*b* refers only to the case of negative corona discharge. It has been ascertained that in the case of positive corona discharge, the current becomes maximum when the distance $x$ is in the vicinity of 10 mm.

In Embodiment 10*a* above, the distance between the discharge electrode 4 and the opposing electrode 6 was adjusted to 10 mm. In order to examine the relation of the distance between the discharge electrode 4 and the opposing electrode 6 to the distance $x$, the distance between the discharge electrode 4 and opposing electrode 6 was adjusted to 18 mm, and the relation between the distance $x$ and the discharge current was examined. The results obtained are plotted in FIG. 11.

In FIG. 11, too, the discharge current per unit area is maximum when the distance $x$ is about 10 mm. Accordingly, there is no close relation between the distance from the discharge electrode to the opposing electrode, and the distance $x$ from the discharge electrode to the shield case, and these distances are considered to define the discharge current independently.

Based on the above information, the bottom ends of both side plates of the shield case 8 were bent inwardly to form Embodiment 12*a* as shown in FIG. 12*a* so that the curved portions became substantially parallel to the opposing electrode 6. The relation between the length $l$ of the bent portion and the discharge current was examined. The results obtained are shown in FIG. 12*b*.

It is seen from FIG. 12*b* that the corona discharge current becomes maximum when the length $l$ is 3 mm. When $l$ is 3 mm, the distance from the discharge electrode to the end of the curved portion is calculated as follows:

$$\sqrt{8^2 + 7^2} = 10.6 \text{ mm.}$$

Probably, the corona current will become maximum when this distance is 10 mm.

Accordingly, the suitable distance between the shield case and the discharge electrode is 10 to 15 mm. Furthermore, it can be appreciated that the discharge current is determined by a conductor which is closest to the discharge electrode, and conductors situated farther from it do not contribute to an increase in the discharge current.

Figure 13A:
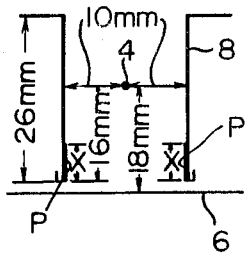

Conductors situated in the vicinity of a circumference with a radius of 10 mm from the discharge electrode contribute to the increase of the discharge current, and conductors located farther are useless. It appears further that the conductors located outside the 10 mm-radius circumference act as an absorbent for the discharge current, and reduce the discharge current. In order to ascertain it, Embodiment 13*a* was tested wherein the bottom portions of both side plates of the shield case to a height of $x$ mm from the bottom were covered with an insulating tape P as shown in FIG. 13*a*, and the relation between changes in length $x$ and the discharge current was examined. The result obtained are plotted in FIG. 13*b*.

Figure 13B:
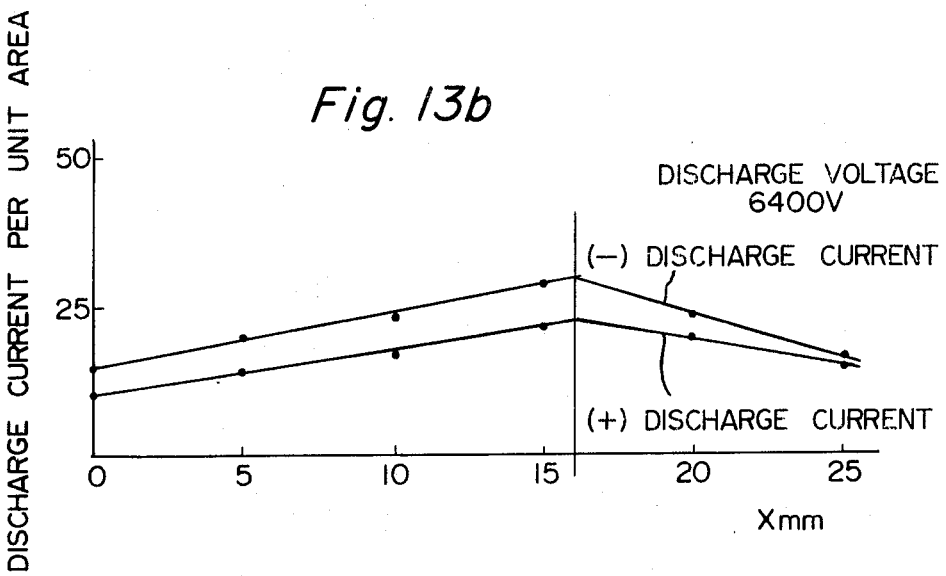

It is presumed from FIG. 13*b* that the discharge current becomes maximum when $x$ is 16 mm; that is, the length of the insulating coating reaches the same level as the discharge electrode. That the discharge current increases as $x$ increases from 0 to 16 mm coincides with the conclusion obtained from Embodiment 12*a* above. This shows that the conductors situated outside the 10 mm-radius circumference act as absorbers of the discharge current. FIG. 13*b* gives the results obtained with a discharge voltage of 6400 V, but the same phenomenon was observed when the discharge voltage was otherwise.

Figure 14A:
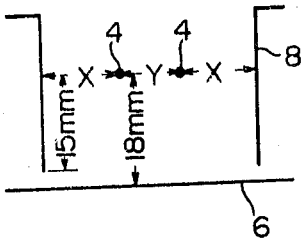

In Embodiments 12*a* and 13*a*, a corona discharge device including one tungsten filament as a discharge electrode was used. In Embodiment 14*a* two tungsten filaments as discharge electrodes as shown in FIG. 14*a* were tested. The relation between the distance $y$ between the discharge electrodes and the distance $x$ between each discharge electrode and the adjacent side plate of the shield case, to the discharge current, was examined. The results obtained are shown in FIG. 14*b*.

Figure 14B:
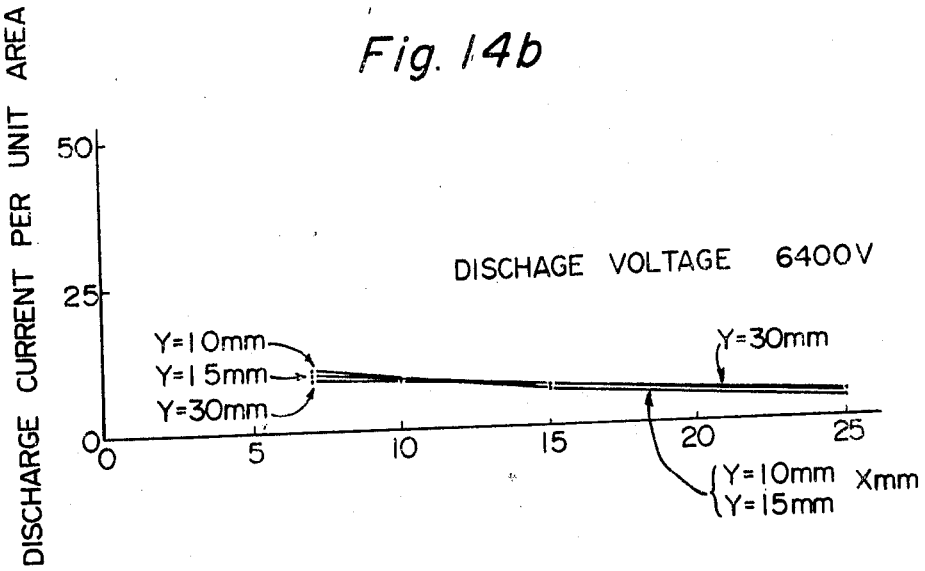

In FIG. 14*b*, the discharge current did not show a peak when the distance $x$ between the side plate of the shield case and each discharge electrode was about 10 mm. But as spark discharge tends to occur when this distance is less than 10 mm, it is appropriate to adjust the distance $x$ to 10 mm – 15 mm. Furthermore, FIG. 14b shows that the distance $y$ between the discharge electrodes does not exert a great influence on the discharge current. Hence, the distance $y$ may be suitably prescribed in consideration of other requirements, for example, the uniformity of discharge.

Now, the discharge electrode itself will be described. Usually, a tungsten filament having a diameter of not more than 0.1 mm is used as the discharge electrode. However, since corona discharge is an electric field emission, the mode of discharge is considered to be affected by the surface condition of the discharge electrode. Therefore, the following four types of tungsten filaments were examined.

(1) A drawn tungsten filament as drawn.
(2) A drawn tungsten filament as drawn chemically treated.
(3) A drawn tungsten filament electrolytically polished.
(4) A tungsten filament subjected to gold plating.

It is well known that generally in corona discharge, a positive corona has good uniformity, but a negative corona has poor uniformity with discharge points appearing at intervals of 3 to 5 mm. Experiments have shown that filament (1) has extremely poor uniformity in negative corona; filament (3) has somewhat good uniformity in negative corona; filament (2) showed good uniformity in negative corona at a discharge voltage of 8000 to 7200 V; and filament (4) subjected to gold plating showed better uniformity in negative corona than the other types of tungsten filament. Filament (4), however, showed deterioration at the gold plated portion at points of even slight spark discharge, and the current at these points is reduced. The filament (4) subjected to gold plating, however, is considered as preferred because it has resistance to oxidation by corona discharge as long as spark discharge is prevented.

Generally, the discharge current decreases with increasing diameter of the discharge electrode. For example, if the application of a discharge voltage of 5600 V to a gold-plated discharge electrode having a diameter of 0.1 mm produces a discharge current of 40 mA, the application of the same discharge voltage to a gold-plated discharge electrode having a diameter of 0.02 mm produces a discharge current of 100 mA. In order to obtain a discharge current of 100 mA, a discharge voltage of 6400 V may be applied to a gold-plated discharge electrode having a diameter of 0.06 mm. Whether to apply a discharge voltage of 5600 V to a discharge electrode with a diameter of 0.02 mm or a discharge voltage of 6400 V to a discharge electrode with a diameter of 0.06 mm in order to obtain a discharge current of 100 mA should be determined in consideration of, for example, the service life of the discharge electrode, the workability of the filament in setting up the discharge electrode, and the efficiency of the voltage applied. In view of these factors, a discharge electrode with a diameter of about 0.06 mm has been found to be generally preferred. For example, a discharge electrode with a diameter of 0.02 mm has a surface area about 1/9 of that with a diameter of 0.06 mm, and therefore, about 9 times as much current flows therethrough per unit area considerably shortening its service life. On the other hand, with a discharge electrode having a diameter of 0.1 mm, a considerably higher voltage (for example, 6800 V) must be applied that with a discharge electrode having a diameter of 0.06 mm in order to obtain the same discharge current (for example, 100 mA), and therefore, the efficiency of the voltage applied becomes poor.

The above are summarized as follows:

(1) The suitable distance (shortest distance) between a discharge electrode and the side plate of a shield case is 10 to 15 mm, for example, about 12 mm.
(2) Those parts within the shield case which are outside the range of the above shortest distance are preferably insulation-coated.
(3) The number of discharge electrodes, and the distances between the electrodes can be properly selected according to the optimum range of charging.
(4) A gold-plated tungsten filament having a diameter of about 0.06 mm is most preferred as the discharge electrode.

The corona discharge device of this invention has been described in detail hereinabove in relation to the electrophotographic process which comprises primarily charging the surface of a photosensitive laminate by applying a DC corona discharge of a specified polarity thereto. This is followed by, simultaneously with light and dark imagewise exposure, secondarily charging it by applying an asymmetric AC corona discharge in which the ratio of a discharge current component having the same polarity as the primary charging to a discharge current component having an opposite polarity to the primary charging is within a specified range. It should be understood however that the corona discharge device of the invention can be conveniently used also in an electrophotographic process of the electrofax type. For example, the invention can be used as a charging device for simultaneously charging the surface and back of a laminate consisting of a back plate and a photoconductive surface layer as desired, or in place of the charging devices disclosed in Japanese Patent Publication No. 9791/65 and Japanese Utility Model Publication No. 20364/65.

Figure 15:
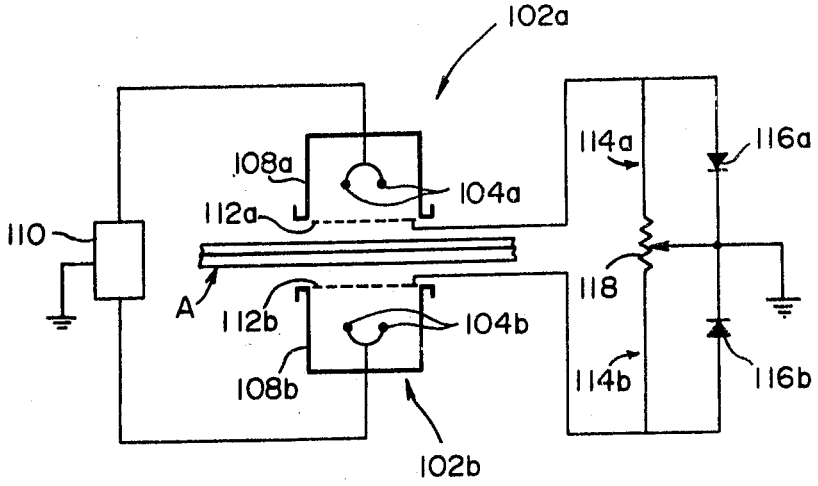
FIG. 15 is a simplified view of a charging device made up of the corona discharge device of this invention for charging the surface and back of a chargeable material at the same time.

FIG. 15 illustrates one embodiment of a charging device for simultaneously charging the surface and back of a chargeable material which is constructed of two corona discharge devices in accordance with the present invention. This charging device includes two corona discharge devices 102a and 102b which respectively have discharge electrodes 104a and 104b which are electrically connected to each other via a grounded high voltage AC source 110. In the device shown, therefore, the discharge electrode 104b of the corona discharge device 102b acts as an opposing electrode of the corona discharge device 102a, and the discharge electrode 104a of the corona dischage device 102a acts as an opposing electrode of the corona discharge device 102b. The corona discharge devices 102a and 102b respectively include shield cases 108a and 108b, and grids 112a and 112b which are respectively disposed between each of the discharge electrodes and the surface or back of a chargeable material A guided between the two corona discharge devices by a suitable means. The grid 112a is grounded through a non-linear bias element 114a composed of a rectifier 116a and an AC impedance element 118 (e.g., a variable resistance) which are parallel-connected to each other. On the other hand, the grid 112b is grounded through a nonlinear bias element 114b composed of a rectifier 116b and the AC impedance element 118 which are parallel-connected to each other.

Figure 16:
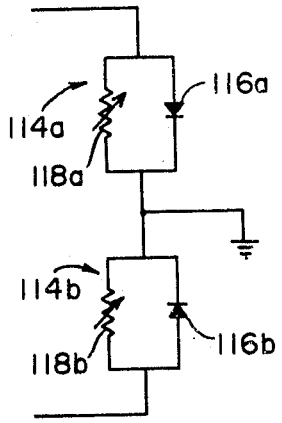
FIG. 16 is a modified example of a nonlinear bias element that can be used in the charging device shown in FIG. 15.

Generally, in a step of simultaneously charging the surface and back of a chargeable material in an electrophotographic process of the electrofax type, it is desired to control the ratio of a discharge current through the surface to that through the back as required. According to the charging device shown in FIG. 15, the ratio of the discharge current through the surface of the chargeable material to that through the back can be easily adjusted to the desired value. For example, the ratio can be adjusted according to the characteristics of the chargeable material, by setting the impedance of the AC impedance element of the nonlinear bias elements 114*a* and 114*b* connected to the grids at suitable values (by suitably adjusting the variable resistances in the case of the embodiment shown in FIG. 15). In FIG. 15, the AC impedance element of the nonlinear bias element 114*a* and the AC impedance element of the nonlinear bias element 114*b* are made of the same variable resistance. If desired, they may be, for example, separate variable resistances as shown at 118*a* and 118*b* in FIG. 16.

While some specific embodiments of the invention have been described in detail hereinabove by reference to the accompanying drawings, it is obvious that the invention is not limited to those specific embodiments, but various changes and modifications are possible without departing from the scope of the invention.

What we claim is:

1. A corona discharge device comprising a corona discharge electrode, an opposing electrode disposed opposite to the corona discharge electrode, a high voltage alternate current source electically connected between the two electrodes, and a grid disposed in a corona discharge current flow path between the two electrodes and grounded through a nonlinear bias element, said nonlinear bias element being composed of an AC impedance element and a rectifier which are connected in parallel with each other.

2. The corona discharge device of claim 1 wherein the nonlinear bias element is composed of first and second variable impedance elements which are parallel-connected to each other and first and second diodes, said first element in series connection with said first diode and said second element in series connection with said second diode which is in anti-parallel relation to said first diode.

3. The corona discharge device of claim 1 wherein the AC impedance element is a variable AC impedance element.

4. The corona discharge device of claim 1 wherein the nonlinear bias element is composed of a first AC impedance element and a first rectifier connected in series to each other and a second AC impedance element and a second rectifier connected in series to each other, the two series-connections are connected in parallel to each other, and the polarity of the first reactifier is opposite to that of the second rectifier.

5. The corona discharge device of claim 4 wherein the first AC impedance element and the second AC impedance element are variable AC impedance elements.

6. The corona discharge device of claim 1 which further includes a shield case to accomodate the discharge electrode therein, and the shortest distance between the discharge electrode and the shield case is 10 to 15 mm.

7. The corona discharge device of claim 6 wherein those parts within the shield case which are located outside the range of the shortest distance with regard to the discharge electrode are insulation-coated.

8. The corona discharge device of claim 1 wherein the discharge electrode is a gold-plated tungsten filament.

9. The corona discharge device of claim 8 wherein the discharge electrode has a diameter of about 0.06 mm.

* * * * *